US006741818B1

(12) United States Patent
Penke et al.

(10) Patent No.: US 6,741,818 B1
(45) Date of Patent: May 25, 2004

(54) PRINTER FEATURE INFORMATION BOARD

(75) Inventors: Mark S. Penke, West Henrietta, NY (US); Kenneth J. Rieck, Victor, NY (US); William Theodore Clark, III, Pittsford, NY (US); Donald A. Brown, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/322,108

(22) Filed: Dec. 17, 2002

(51) Int. Cl.[7] ..... G03G 15/00
(52) U.S. Cl. ..... 399/81; 399/107
(58) Field of Search ..... 399/81, 107, 110

(56) References Cited

U.S. PATENT DOCUMENTS 5,463,448 A * 10/1995 Wilson et al. ..... 399/81
5,687,297 A 11/1997 Coonan et al. ..... 395/102
6,069,624 A 5/2000 Dash et al. ..... 345/333
6,266,512 B1 7/2001 DeKoning et al. ..... 399/370

OTHER PUBLICATIONS

Xerox—Equipment Identification Handbook—2002.

* cited by examiner

*Primary Examiner*—Hoang Ngo
(74) *Attorney, Agent, or Firm*—Richard F. Spooner

(57) ABSTRACT

A relatively thin feature information board placed in an essentially upright position proximate to the rear top surface of a multifunctional printer for conveying information concerning the feature capabilities of the printer. The feature information board is generally taller than other features of the marking engine module of the multifunctional printer. The feature information board may contain an active interface region that conveys information concerning the availability of the multifunctional services and status information such as, fault conditions, completion of jobs, and that jobs are in progress.

37 Claims, 4 Drawing Sheets

PRINTER FEATURE INFORMATION BOARD

FIELD OF THE INVENTION

The field of the present invention is multifunctional printers and, more particularly, human interface mechanisms for multifunctional printers.

BACKGROUND AND SUMMARY

Xerographic copiers have been used in office environments since the advent of the Xerox 914® in 1959. Xerographic printers have been used in office environments since the Xerox 1200® was introduced in 1973. Multifunctional printers capable of both copy and print services as well as scan and fax services have become ubiquitous in modern office environments in the mid to late 1990's. Throughout each of these evolutions one guiding human factor principle has been to make the units as small and compact as possible. In particular, small footprints have been emphasized as well as maintaining the top surfaces of units either at walk-up standing height (typically around 38 to 39 inches high for the platen glass inches high) or at desk top height.

Although production printing systems often have cathode ray or flat panel interface screens mounted in an upright fashion above the primary top surface of the system, office printers have traditionally placed user interfaces essentially horizontally on the top surface of the machines or, at most, along a back ridge rising no more than 7 inches above the main top surface of the system. In older systems with larger footprints than today's typical office multifunctional printer, a document feeder/handler was often placed at one end of the top surface of the system, and the rear raised ridge with interface information and control buttons was placed along the portion of the top surface that remained unobstructed by the documents feeder/handler. As footprints have gotten smaller, the typical document feeder/handler has occupied a greater proportion of the top surface of office multifunctional printer systems. This decreasing footprint and need to mount the document feeder/handler has essentially forced the user interface displays and control functions onto an essentially horizontal surface near the front of the system. In this manner, a user can easily walk-up to the system, look down, and obtain relatively easy access to the user interface and relevant information for machine status and control. The above history and trends can be traced in the Xerox Equipment Handbook which displays line drawings of all of Xerox office products since the Xerox 1090 copier launched in 1985.

Vertical message boards have not heretofore been associated with office equipment and especially not with multifunctional printers. Even stand-alone kiosks and vertical message boards of the type found, in malls communicate either information concerning surroundings external to the kiosk such as maps, advertising and directions, or information concerning the operation of equipment included within the kiosk itself, such as, for example, the instructions on a photo-kiosk.

What is missing in an office environment is a vertically disposed message board intended less to convey instructional information than to convey non-obvious information concerning the capabilities of the equipment to which it is attached. What is also missing in the prior art and especially in modern multifunctional printer products, is a display that enables a user, or bystander to quickly understand while at a distance the core services of which the system is capable and some information regarding the system status. It would be desirable to enable the user to obtain this information without the need to walk up to the machine to either look down and the interface module or to be close enough to relatively small buttons and displays in order to be able to read the information. As an example, it would be beneficial if a user that wishes to make a walk-up copy on a multifunctional printer could seen from 20 or more feet whether the machine is currently occupied with another job. Such information visible from afar would save the user from walking up to the system and waiting for the job in progress to clear. Similarly, highly visible information that indicates a malfunction with a machine can more easily draw attention that the system needs attending. There would then be less likelihood that the system would remain disabled while users continue to create a backlog in its queue with jobs that can't be currently printed or processed.

One aspect of the invention is a multifunctional printer having a marking engine module that has a rear wall and has a plane view width dimension and a maximum plane view height dimension, a feature information board assembly, comprising: a feature information board having a width dimension that is wider than the width dimension of the marking engine module and a height dimension that is at least about 4 inches higher than the maximum height dimension of the marking engine module; attachment fixtures for attaching the feature information board in an essentially upright position proximate to the rear wall of the marking engine module; and human recognizable symbols located on the feature information board for conveying information concerning the feature capabilities of the multifunctional printer.

Another aspect of the invention is a multifunctional printer having a marking engine module that has a rear top edge and has a maximum height dimension, a feature information board assembly, comprising: an inactive display region attached to the rear top edge of the marking engine module; an active interface module comprising human interpretable indicators indicating which services the multifunctional printer is capable of performing, said active interface module being attached to the inactive display region, wherein the combination of the inactive display region and active interface module attain a height dimension at least about 4 inches higher than the maximum height dimension of the marking engine module; and attachment fixtures for attaching the feature information board proximate to rear wall of the marking engine module.

Yet another aspect of the invention is a multifunctional printer, comprising: a marking engine module that has a rear wall and has a plane view width dimension and a maximum plane view height dimension; a feature information board having a width dimension that is wider than the width dimension of the marking engine module and a height dimension that is at least about 4 inches higher than the maximum height dimension of the marking engine module; attachment fixtures for attaching the feature information board in an essentially upright position proximate to the rear wall of the marking engine module; and human recognizable symbols located on the feature information board for conveying information concerning the feature capabilities of the multifunctional printer.

Yet another aspect of the present invention is a process for a multifunctional printer having a marking engine module that has a rear wall and has a plane view width dimension and a maximum plane view height dimension, a process for conveying information describing the feature capabilities of the multifunctional printer, said process comprising: forming a feature information board having a width dimension that is wider than the width dimension of the marking engine module and a height dimension that is at least about 4 inches higher than the maximum height dimension of the marking engine module; attaching the feature information board in an essentially upright position proximate to the rear wall of the marking engine module; and placing human recognizable symbols on the feature information for conveying information concerning the feature capabilities of the multifunctional printer.

DESCRIPTION

Figure 1:
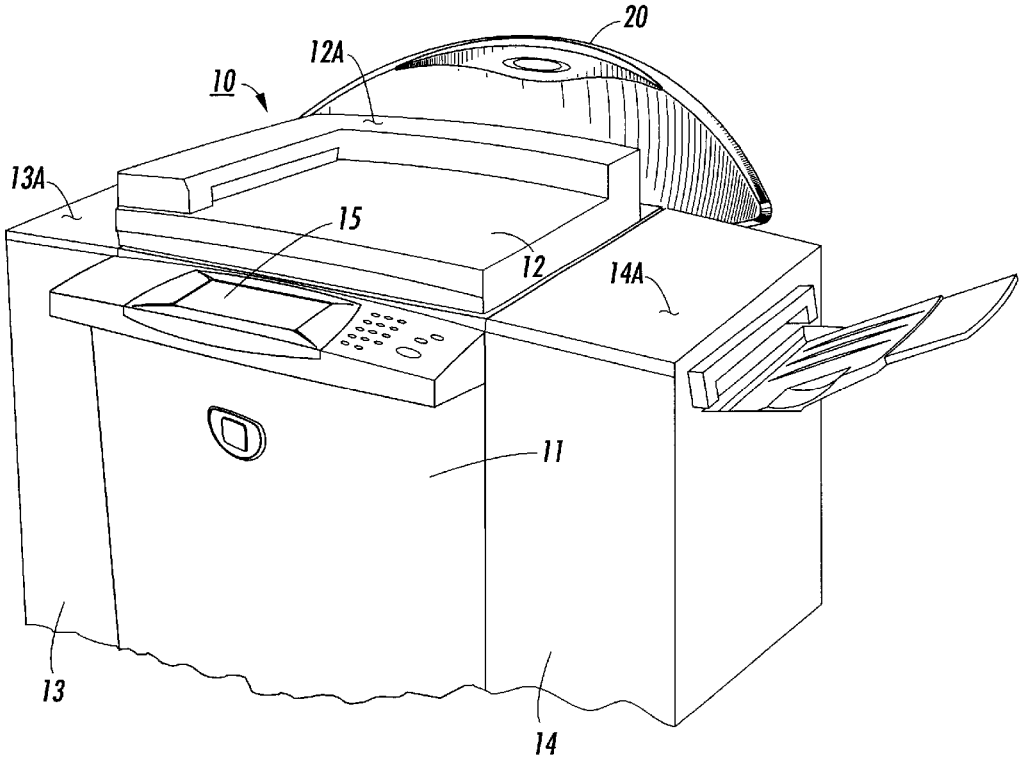
FIG. 1 is an elevated plane view of an exemplary multifunctional printer comprising a feature information board of the present invention.

For a general understanding of the present invention, reference is made to the drawings. In the drawings, like reference numerals have been used throughout to designate identical elements.

An exemplary system comprising one embodiment of the present invention is a multifunctional printer with print, copy, scan, and fax services. Such multifunctional printers are well known in the art and may comprise print engines based upon liquid or solid ink jet, electrophotography, and other imaging technologies. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, for example, U.S. Pat. No. 6,069,624 issued to Dash, et al. and U.S. Pat. No. 5,687,297 issued to Coonan et al., both of which are hereby incorporated herein by reference.

Referring first to FIG. 1, one embodiment of the present invention is shown in relation to an exemplary multifunctional printer 10. In the middle is the main printing engine of the system housed in module 11. On top of print module 11 is a document feeder/handler module 12. Immediately below module 12 and inside print module 11 is a scanning module (not shown). To the left of module 11 in FIG. 1 is a copy substrate feeder 13. To the right of module 11 in FIG. 1 is an assembler/finisher module 14, typically capable of collating, stapling, stacking, and similar finishing and assembling functions. On the top surface of print module 11 and oriented essentially horizontally along the top in front of document feeder/handler module 12 is an essentially conventional interface and display module 15. Some combination of some or all of modules 11–15 are found in most office environment multifunctional printers. Collectively, these modules shall be referred to as "Standard Modules". Those skilled in the art will recognize that marking engine module 11 may contain a large variety of print engine technologies, including, without limitation, electrostatographic print engines such as, print engines based on xerography and ink jet print engines based on acoustic, liquid, or phase-change technologies.

On top of system 10 is one embodiment of a feature information board ("FIB") 20 of the present invention. Unlike prior art interface displays, the upper profile of FIB 20 rises significantly above other portions of the upper profile of printer system 10. Such upper profile of printer system 10 is comprised of the top surface 14A of assembled/finisher module 14, the top surface 13A of substrate feeder module 13, and the top surface 12A of feeder/handler module 12. As described above, prior art interface and control displays such as interface module 15 do not contribute significantly or at all to the upper profile of systems such as printer system 10. Preferably, FIB 20 rises at least 4 inches above the upper most profile of document feeder/handler module 12 or other of the Standard Modules of printer system 10. More preferably, FIB 20 rises higher than about 4 inches and more preferably to a height of about 6 or more inches above the upper most profile of the Standard Modules of printer system 10.

Another characteristic of the FIB 20 shown in FIG. 1 is its face-on plane view lateral width in relation to the Standard, Modules of printer system 10. In prior art interface and control modules 15, the plane view lateral width dimension of module 15 has been limited by the width dimension of print module 11. In other words, interface and control modules for conventional printer systems have been wholly contained within print module 11 and, as a result, their width has been constrained by the width of print module 11. In contrast, the face-on lateral width of FIB 20 shown in FIG. 1 extends significantly beyond the width of print module 11. Preferably, the width of FIB 20 extends at least 5 and more preferably 7 or more inches in lateral width more than the width dimension of print module 11. Most preferably, FIB 20 extends at least one-half the plane view lateral width of the top surfaces 13A and 14A of the substrate feeder module 13 and the assembler/finisher module 14, respectively. It should be noted that FIB 20 is typically mounted along the rear edge of the Standard Modules and behind document feeder/handler 12. In this manner, it does not obstruct user access to any features or portions of the Standard Module, including standard interface module 15.

Yet another characteristic of the FIB 20 embodiment shown in FIG. 1 is its symmetrically arcuately shaped top profile centered upon the visual center of print module 11. Although FIB 20 may assume any shape, the symmetrical arcuate shape is preferred.

Figure 2:
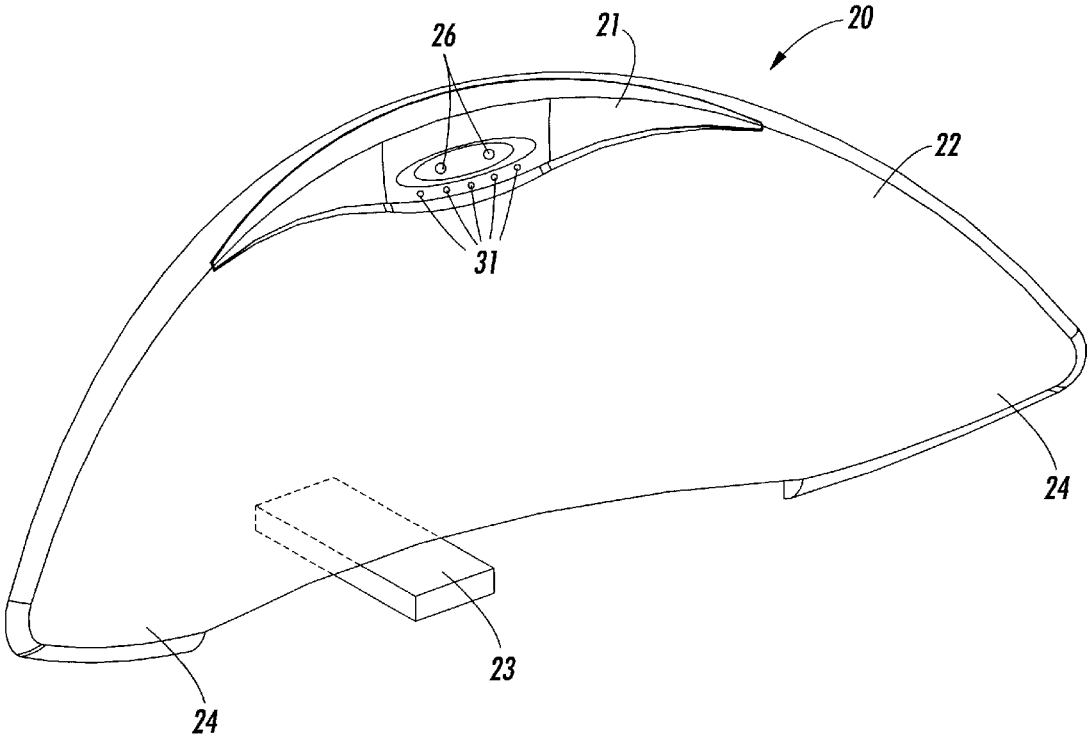
FIG. 2 is an elevated perspective view of a feature information board of the invention separated from the remainder of the multifunctional printer.

With reference to FIG. 2, a perspective view of FIB 20 is shown once removed from printer system 10. As shown in FIG. 2, FIB 20 has an active interface module 21, an inactive display region 22, electronic connection module 23, and an attachment/structural region 24.

Referring first to attachment/structural region 24, the function of this supports is both to attach FIB 20 to the rear wall of printer 10 and to provide structural rigidity to FIB 20. It is desirable that FIB 20 be sturdily mounted in order to look and feel like an integral part of printer system 10. At the same time, FIB 20 is designed to be removable when needed for maintenance and repair. Attachment/support region 24 and its attachment mechanism thus should enable easy detachment when desired and sturdy attachment. A wide variety of attachment/support mechanisms have been designed. In some, attachment/support struts fasten to the rear wall of marking module 11 and to attachment/support region 24. In other designs attachment/support region 24 simply slides into a fastening fixture mounted on the rear wall of marking module 11. In still others, attachment/support region 24 comprises fixtures that extend toward and are fastened into the rear wall of marker module 11 and the rear walls of Standard Modules 13 and 14. In still others, a simple bolting operation is required to mate attachment/support region 24 with the rear walls of one or more of Standard Modules 13–14.

In some embodiments, FIB 20 is convexly bowed in relation to the rear walls of Standard Modules 13–14. The result is a separation of several inches between (1) the rear of top surfaces 11A of the marker engine and 12A of the document feeder and (2) the center convexly bowed portion of FIB 20 that proximate to the rear top surfaces 11A and 12A. This spaced apart appearance is made even greater when FIB 20 is mounted at an inclined angle receding from the rear walls of the Standard Modules. In one embodiment, FIB 20 is inclined approximately 12–18 degrees from vertical.

Referring now to inactive display region 22, this region is visible above the rear edge of Standard Modules 11, 13, and 14 and is connected and supported in a generally upright or slightly inclined position by attachment/support region 24 and its attachment mechanism. For those printer systems 10 in which document feeder/handler 12 (FIG. 1) is hinged along its rear edge to allow documents to be placed on the scanner platen, region 22 must be located far enough behind document feeder/handler 12 to enable free rotation of document feeder/handler around its hinge. This typically requires a space of about 2.5 to 4 inches between the hinge and region 22 of FIB 20. The convex bow shape and backward mounting inclination of FIB 20 helps create a space. Since it is desirable to keep the total depth of printer system 10 to a minimum, region 22 of FIB 20 is typically no thicker than 2 inches and, preferably, 1.5 inches. Although the thickness of FIB 20 and region 22 increases the total depth of printer system 10, especially if several inches are additionally required for clearance of the document feeder/handler 12, it is not intended that FIB 20 and its components require that printer system 10 be moved more than several inches further from a wall than would be necessary without FIB 20. Preferably, FIB 20 does not alter positioning of printer system 10 at all. The reason is that although FIB 20 and its components extend backward from near the top surfaces of printer system 10, they extend into the space:that is already required to separate printer system 10 from a wall in order to provide adequate cooling ventilation and space for electrical cords, etc.

In addition to its function of supporting active interface module 21, inactive display region 22 is useful for carrying instructional information, brand identification, and identification of services and other functions available with printer system 10. Such information in the form of symbols, including icons and words, can be simply printed on region 22, may be molded into the surface of region 22, or may be removably placed on region 22 by such means as use of low-tack adhesive labels. When printer system 10 is on display at a point of purchase, region 22 is also useful in providing a large surface on which system specifications and features can be clearly displayed. Since region 22 is highly visible from a reasonable distance because of its upright surface on top of Standard Modules 11, 13, and 14, it may be particularly suitable for a temporary covering of low-tack plastic film on which large letters and other information can be printed. Once printer system 10 is installed at the user site, this plastic film can be easily delaminated from the surface of region 22. In addition to its informational value, such plastic film covering is useful in protecting the surface of region 22 from scratches, dirt, and minor dents during display, shipping, and installation.

In one embodiment of the invention, there is not an active interface module 21, and inactive display region 22 comprises essentially the entire visible portion of FIB 20. In this embodiment, region 22 is useful for quickly informing potential users which services are available with the printer system 10. Experience indicates that casual users of multifunctional printers are not aware of all of the services embodied in the system nor of the features associated with each service. Because region 22 and FIB 20 is highly visible and noticeable, it offers an ideal location to inform users of a system's capabilities, thereby creating greater value for the user, customer/owner, and manufacturer. In this embodiment, the main purpose of FIB 20 is to convey information concerning the feature capabilities of multifunctional printer 10.

Referring now to active interface module 21, this region is placed in FIG. 1 at the top of inactive display region 22. Module 21 may take any shape, size, and location on FIB 20. It seems desirable, however, to place module 21 at the apex of FIB 20 in order to make its information most noticeable from the furthest distance. Structurally, module 21 may be a permanently fixed portion of FIB 20 or, more likely, a modular element of FIB 20 that can be easily detached and replaced when desired.

Located within module 21 are one or more human interpretable indicators such as illuminated bulbs, words, or icons. In FIG. 2, these indicators are indicated by illumination features 31. Illumination may be by means of LEDs located below translucent coverings, incandescent bulbs, or any other illumination means. In one embodiment, there is at least one human interpretable indicator 31 for each service available in printer system 10. For example, if printer system 10 is configured for copy, fax, print and scan services, then module 21 preferably has at least 4 human interpretable indicators, each associated with one of the services. An example may include illuminators 31 such as LEDs placed underneath translucent coverings in the shape of a fax icon or in the shape of the word "Fax". If printer system 10 is configured for fewer services, then a correspondingly fewer number of human interpretable indicators 31 would be mounted in module 21.

Figure 3:
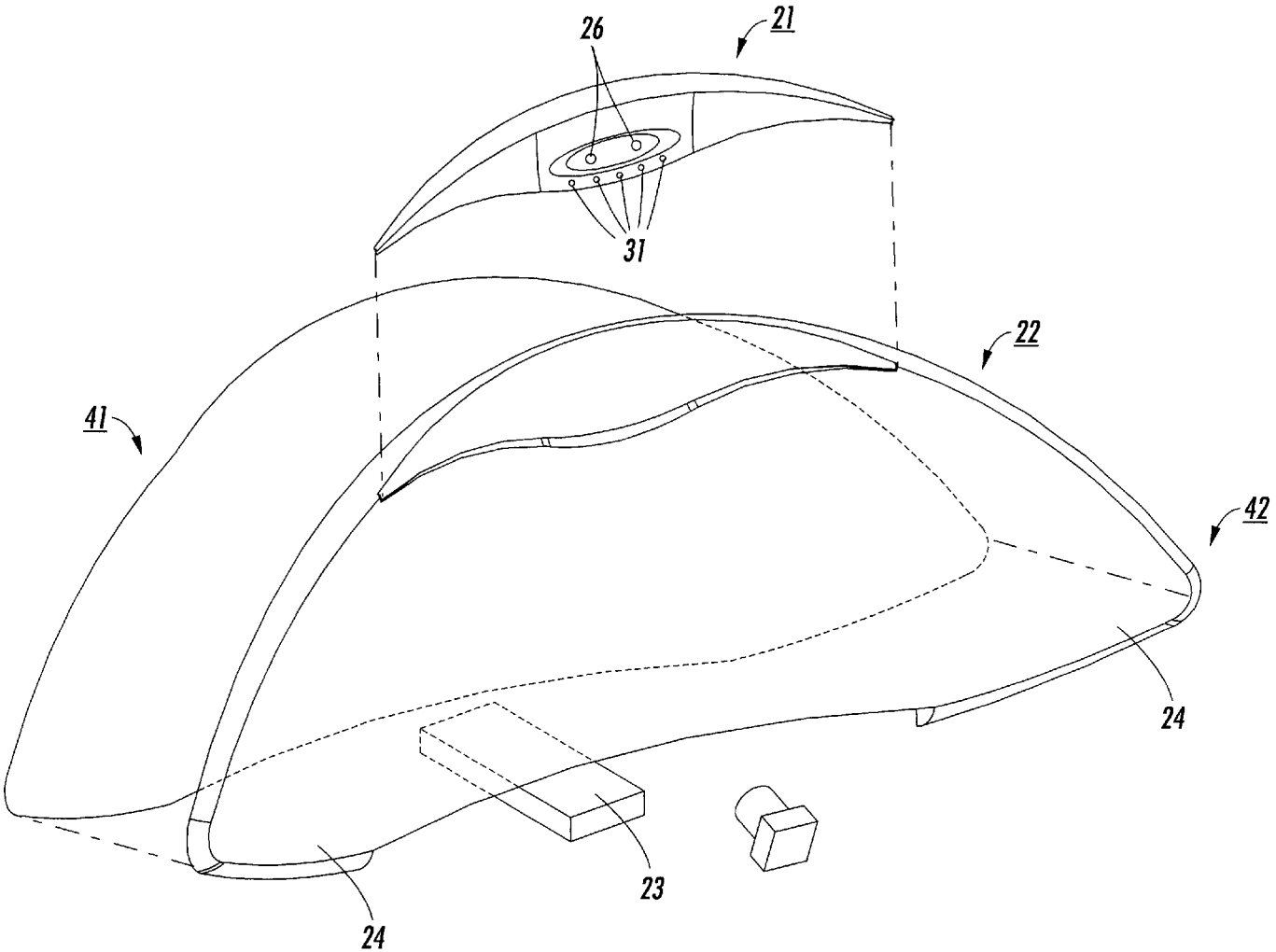
FIG. 3 is an elevated exploded view of a feature information board of the invention showing exemplary parts.

Referring now to FIG. 3, an exploded view of FIB 20 is shown. As shown, active interface module 21 is detachably connected to display region 22. One advantage of a removably mounted module 21 is the ability to change its configuration to adapt to any upgrades or changes in features available in printer system 10. For example, multifunctional printer systems 10 are often first installed with fewer than all services being enabled. Upon the occurrence of a system upgrade, a service representative can detach the original module 21 and replace it with a new module that correctly identifies the new services available. This ability to significantly change the visual presentation of printer system 10 in the field through a simple modular exchange offers a convenient manner to notify potential users that the system configuration has been changed. From a manufacturer's perspective, it is highly desirable that as many users as possible know and use the available features of printer system 10 in order that the system be perceived as high value-added office equipment worthy of maintenance and brand loyalty.

Referring again to FIG. 2, another embodiment of active interface module 21 is shown by the highlighting of the service currently in use. In one version of this embodiment, human interpretable indicators 31 associated with each of the available services are illuminated. When one service is in use, the indicator 31 associated with this service blinks or is illuminated in a brighter fashion. In this manner, a potential user can see without walking up to the machine that a job is in progress. If the user is waiting to receive output from the system, e.g. a fax, then the user can remain at a distance and productive with other tasks. With an occasional glance, the user can determine whether the desired job has been completed. In yet another embodiment, human interpretable indicators are configured first to indicate that a job of a particular service is in progress and then to indicate that a job of that service is complete and available for removal from printer system 10. The presence of a job in an output tray may be accomplished by any number of substrate sensors that are well known in the art. See, for example, U.S. Pat. No. 6,266,512 issued to DeKoning et al. The ability to convey that a job is first in progress and then is complete can be accomplished using multiple indicators 31 or combinations of blinking and/or brighter illumination to indicate various states of the job in progress. Generally, active interface module 21 conveys information but, unlike a conventional user interface, cannot receive user input Yet another embodiment of the invention is the use of human interpretable indicators 26 on module 21 to indicate a state of system fault. Again, a key advantage of such display is the ability to inform potential users located at a distance that the system needs servicing. By drawing attention to a fault condition in printer system 10, service may be rendered more quickly and machine availability is more likely for users at the time when jobs are submitted for processing. In one version of this embodiment, a simple red light may be illuminated when a fault is detected. Greater attention may be drawn if this light blinks. In another version of this embodiment, a fault that does not prevent full operation of printer system 10 may cause an unblinking red or fault indicator 26 to illuminate. Such a fault may be a low toner condition or the unavailability of a network or fax connection. If the fault condition prevents operation of all services of printer system 10, then the fault indicator 26 may blink, become brighter, or otherwise become more obvious to users located at a distance.

Yet another embodiment of the invention provides a manner in which human interpretable indicators 31 also indicate availability for each service. For example, if the print and copy function of printer system 10 is unavailable due to a paper jam, indicators 31 for the scan and fax services may remain lit or otherwise indicate availability of these services. When combined with fault indicators 26 described above, each service may have an availability indicator 31 and a fault indicator 26. A user at a distance could then immediately detect which services are available and which are currently unavailable due to a fault condition.

Referring again to FIG. 2, electronic connection module 23 is shown as a separate male projection that descends below inactive display region 22. Those skilled in the art will recognize that electronic connection module 23 may be embedded in any support members or attachment fixtures connected between attachment/support region 24 and one or more of the Standard Modules. Connection module 23 may also be in the form of a simple cable extending from active interface module 21 to one or more of the Standard Modules 11, 13, and 14. All that is necessary is for electronic connection module 23 to conduct enough electricity to power module 21 and to be capable of carrying command signals from the system controller (not shown).

Referring again to FIG. 3, the exploded view of FIB 20 shows one manner of constructing FIB 20 and its components. As indicated above, active interface module 21 may typically be assembled separately and removably attached to the remainder of FIB 20. In the embodiment shown in FIG. 3, inactive display region 22 is comprised of a plastic or metal frame member 41 that provides the basic shape and support for FIB 20. A metal frontal skin 42 is then printed with desired information and formed over frame member 41. Alternatively, skin 42 may be of any suitable material such as plastic sheeting and may have molded and/or printed or painted lettering, icons and other informational indicators. Attachment/structural supports 23 may be integrated with frame member 41 or may be formed or separate members.

Figure 4:
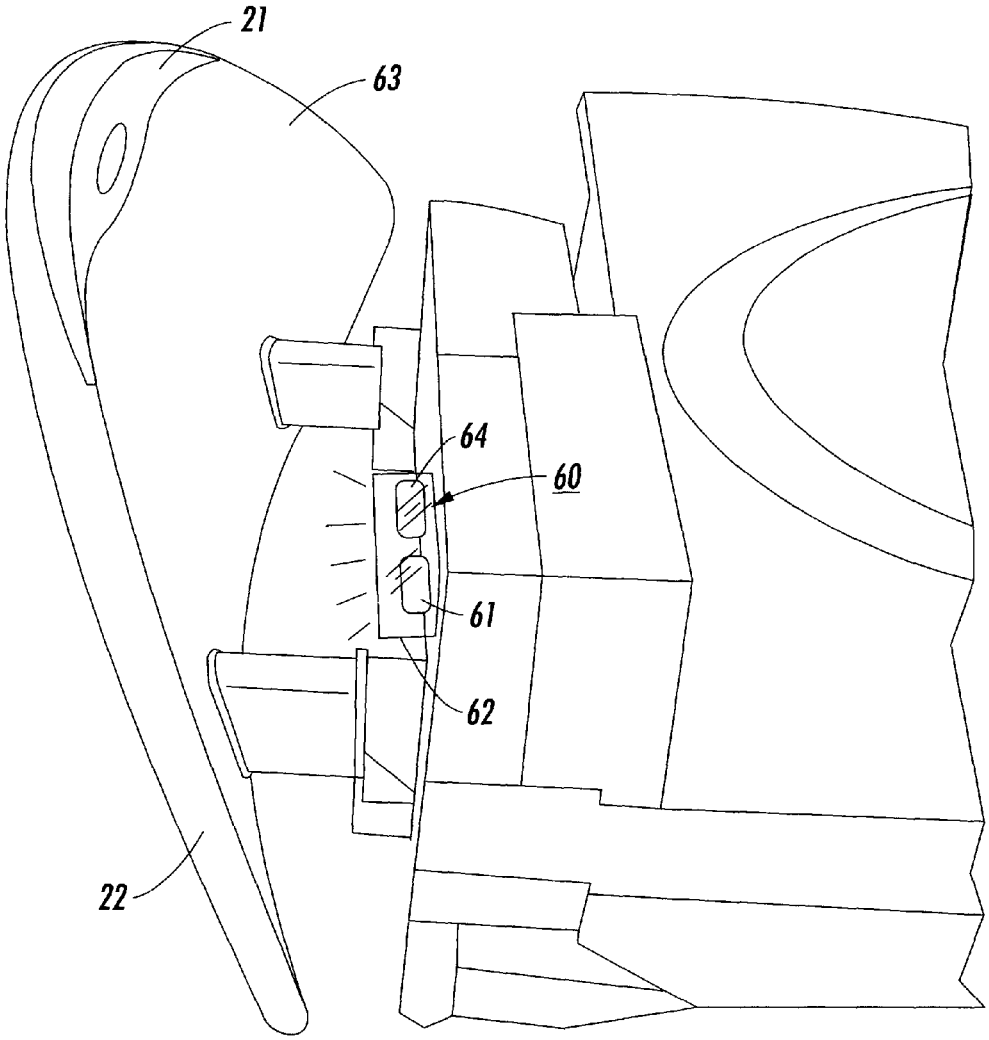
FIG. 4 is an elevated perspective view of a feature information board of the invention comprising an indirect illumination embodiment.

Referring now to FIG. 4, another embodiment of the invention is made possible by the relative height of FIB 20. Specifically, FIB 20 provides a surface for reflecting attractive indirect lighting from lighting fixture 60. Such indirect lighting may be wholly decorative or may convey important system information. In one embodiment, a printer system 10 configured with color printing capability has a FIB 20 illuminated with multi-colored illumination that indicates the color capability. A similar printer system 10 that lacks the color capability may comprise a FIB 20 without the indirect lighting feature 60 or with only a monochrome indirect lighting feature 60. In this manner, a user unfamiliar with the system will know immediately whether printer system 10 comprises the color or the monochrome version of the system. Such lighting will be more distinctive than the simple prior art color icons that typically denote that a system is color capable. In the embodiment shown in FIG. 4, indirect lighting fixture 60 comprises a small light 61 such as, a halogen-quartz lamp, an optional di-chromatic glass plate 62 positioned above lamp 61 to add color if desired, and reflecting wall 63, which may be inactive display region 22 of FIB 20. For printer systems that can be configured in monochrome, highlight color, or process color configurations, lighting fixture 60 can easily differentiate the configurations by conveying color patterns associated with each of the configurations, for example, a prism rainbow of continuous colors vs. a pattern of one or a small number of discontinuous colors.

In addition to conveying color capability, lighting fixture 60 may also be used to highlight system status in a manner similar to module 21. For instance, if a fault condition exists, the first lamp 61 may be extinguished and a second lamp 64 may be illuminated in a color that indicates the fault condition. Any number of similar variations are possible, including without limitation blinking of lamp 61 when a fault condition exists.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. In a multifunctional printer having a marking engine module that has a rear wall and has a plane view width dimension and a maximum plane view height dimension, a feature information board assembly, comprising:

a. a feature information board having a width dimension that is wider than the width dimension of the marking engine module;

b. attachment features for attaching the feature information board proximate to the rear wall of the marking engine module; and c. human recognizable symbols located on the feature information board for conveying information concerning the feature capabilities of the multifunctional printer.

2. The feature information board assembly of claim 1, wherein the feature information board has a height dimension that is at least about 4 inches higher than the maximum height dimension of the marking engine module.

3. The feature information board assembly of claim 1, wherein the marking engine module has a rear wall and a depth dimension and wherein a portion of the feature information board assembly extends beyond the rear wall of the marking engine module, thereby increasing the depth dimension of the multifunctional printer.

4. The feature information board assembly of claim 1, further comprising a temporary plastic covering over at least a portion of the feature information board, said plastic covering containing human recognizable symbols conveying information concerning the feature capabilities of the multifunctional printer.

5. The feature information board assembly of claim 1, wherein the marking engine module has a top surface and wherein the feature information board assembly further comprises a source of lighting located proximate to the top surface of the marking engine module that illuminates a portion of the feature information board.

6. The feature information board assembly of claim 5, wherein the source of lighting further comprises a color code designating the multifunctional printer as having a color printing capability selected from the group of color capabilities consisting of monochrome, highlight color, and process color.

7. The feature information board assembly of claim 1, wherein the feature information board further comprises an active interface module.

8. The feature information board assembly of claim 7, wherein the active interface module is removably attached.

9. The feature information board assembly of claim 7, wherein the active interface module further comprises human interpretable indicators indicating which services the multifunctional printer is capable of performing.

10. The feature information board assembly of claim 7, wherein the active interface module is located proximately to the apex of the feature information board.

11. The feature information board assembly of claim 7, wherein the multifunctional printer has a controller in communication with the active interface module and wherein the active interface controller further comprises human interpretable indicators that indicate which services are currently available for providing service.

12. The feature information board assembly of claim 7, wherein the multifunctional printer has a controller in communication with the active interface module and wherein the active interface controller further comprises human interpretable indicators that indicate which service is currently in use.

13. The feature information board assembly of claim 7, wherein the multifunctional printer has a controller in communication with the active interface module and wherein the active interface controller further comprises a human interpretable indicator that indicates a fault condition in the multifunctional printer.

14. The feature information board assembly of claim 7, wherein the multifunctional printer has a controller in communication with the active interface module and wherein the active interface controller further comprises human interpretable indicators that indicate which services are free from fault condition, whether a service is in use, and whether a fault condition exists in respect to any service.

15. The feature information board assembly of claim 7, wherein the multifunctional printer has a controller in communication with the active interface module and wherein the active interface controller further comprises a human interpretable indicator that indicates when a job has been completed.

16. The feature information board assembly of claim 7, wherein the human interpretable indicators comprise LED illuminators.

17. The feature information board assembly of claim 7, wherein the multifunctional printer has a controller in communication with the active interface module and wherein the active interface controller further comprises a human interpretable indicator complex that conveys information by alteration of its appearance, such alteration being selected from the group consisting essentially of changing brightness, blinking, and changing color.

18. The feature information board assembly of claim 1, wherein the feature information board has a thickness that is less than 2 inches.

19. The feature information board assembly of claim 1, wherein the feature information board has a top edge and wherein the top edge is arcuately shaped.

20. The feature information board assembly of claim 1, wherein the feature information board is convexly bowed away from the marking engine rear wall.

21. The feature information board assembly of claim 1, wherein the feature information board is inclined rearward relative to the rear wall of the marking engine module.

22. The feature information board assembly of claim 21, wherein the angle of inclination is approximately 12 degrees from vertical.

23. In a multifunctional printer having a marking engine module that has a rear top edge and has a maximum height dimension, a feature information board assembly, comprising:

a. an inactive display region attached to the rear top edge of the marking engine module;

b. an active interface module comprising human interpretable indicators indicating which services the multifunctional printer is capable of performing, said active interface module being attached to the inactive display region, wherein the combination of the inactive display region and active interface module attain a height dimension greater than approximately 4 inches higher than the maximum height dimension of the marking engine module; and c. attachment features for attaching the feature information board proximate to rear wall of the marking engine module.

24. The feature information board assembly of claim 23, wherein the multifunctional printer has a controller in communication with the active interface module and wherein the active interface controller further comprises human interpretable indicators that indicate which services are currently available for providing service.

25. The feature information board assembly of claim 23, wherein the multifunctional printer has a controller in communication with the active interface module and wherein the active interface controller further comprises human interpretable indicators that indicate which service is currently in use.

26. The feature information board assembly of claim 23, wherein the multifunctional printer has a controller in communication with the active interface module and wherein the active interface controller further comprises a human interpretable indicator that indicates a fault condition in the multifunctional printer.

27. The feature information board assembly of claim 23, wherein the multifunctional printer has a controller in communication with the active interface module and wherein the active interface controller further comprises human interpretable indicators that indicate which services are free from fault condition, whether a service is in use, and whether a fault condition exists in respect to any service.

28. The feature information board assembly of claim 23, wherein the multifunctional printer has a controller in communication with the active interface module and wherein the active interface controller further comprises a human interpretable indicator that indicates when a job has been completed.

29. The feature information board assembly of claim 23, wherein the human interpretable indicators comprise LED illuminators.

30. The feature information board assembly of claim 23, wherein the multifunctional printer has a controller in communication with the active interface module and wherein the active interface controller further comprises a human interpretable indicator that conveys information by alteration of its appearance, such alteration being selected from the group of alterations consisting essentially of changing brightness, blinking, and changing color.

31. The feature information board assembly of claim 23, wherein the multifunctional printer has an interactive user interface for receiving user input and wherein the active interface module lacks the ability to receive user input.

32. A multifunctional printer, comprising:

a. a marking engine module that has a rear wall and has a plane view width dimension and a maximum,plane view height dimension;

b. a feature information board having a width dimension that is wider than the width dimension of the marking engine module;

c. attachment features for attaching the feature information board proximate to the rear wall of the marking engine module; and d. human recognizable symbols located on the feature information board for conveying information concerning the feature capabilities of the multifunctional printer.

33. The electrophotographic printer of claim 32, wherein the feature information board has a height dimension that is greater than approximately 4 inches higher than the maximum height dimension of the marking engine module.

34. The electrophotographic printer of claim 32, further comprising:

a controller;

an interactive human interface capable of receiving human input;

an active interface module, communicating with the controller and comprising a portion of the feature information board, wherein said active interface module lacks the capability of receiving user input.

35. In a multifunctional printer having a marking engine module that has a rear wall and has a plane view width dimension and a maximum plane view height dimension, a process for conveying information describing the feature capabilities of the multifunctional printer, said process comprising:

a. forming a feature information board having a width dimension that is wider than the width dimension of the marking engine module;

b. attaching the feature information board proximate to the rear wall of the marking engine module; and c. placing human recognizable symbols on the feature information for conveying information concerning the feature capabilities of the multifunctional printer.

36. The process of claim 35, wherein attaching further comprises attaching the feature information board such that its height dimension after attachment is greater than approximately 4 inches higher than the maximum height dimension of the marking engine module.

37. The feature information board assembly of claim 23, wherein the marking engine module has a rear wall and a depth dimension and wherein a portion of the feature information board assembly extends beyond the rear wall of the marking engine module, thereby increasing the depth dimension of the multifunctional printer.

* * * * *